US007340999B2

(12) United States Patent
Hinz et al.

(10) Patent No.: US 7,340,999 B2
(45) Date of Patent: Mar. 11, 2008

(54) METHOD FOR OPERATING A MULTI-ROLL CALENDAR AND A CALENDAR

(75) Inventors: Joachim Hinz, Kempen (DE); Josef Schneid, Vogt (DE); Thomas Koller, Toenisvorst (DE)

(73) Assignee: Voith Paper Patent GmbH, Heidenheim (DE)

( * ) Notice: Subject to any disclaimer, the term of this patent is extended or adjusted under 35 U.S.C. 154(b) by 196 days.

(21) Appl. No.: 11/038,082

(22) Filed: Jan. 21, 2005

(65) Prior Publication Data

US 2005/0178278 A1 Aug. 18, 2005

(30) Foreign Application Priority Data

Jan. 24, 2004 (DE) ..... 10 2004 003 715

(51) Int. Cl.
*B30B 15/34* (2006.01)
*B30B 3/04* (2006.01)

(52) U.S. Cl. ..... 100/161; 100/38; 100/174; 100/331; 100/332

(58) Field of Classification Search ..... 100/38, 100/327, 329, 331, 332, 155 R, 161, 162 R, 100/163 R, 168, 174
See application file for complete search history.

(56) References Cited

U.S. PATENT DOCUMENTS 4,332,191 A * 6/1982 Kankaanpaa ..... 100/162 R
4,375,188 A * 3/1983 Leiviska ..... 100/162 R
4,960,046 A 10/1990 Anstötz et al.
5,947,017 A 9/1999 Hartwich et al.
6,248,215 B1 6/2001 Cramer et al.

FOREIGN PATENT DOCUMENTS

| | | |
|---|---|---|
| DE | 3107709 A1 * | 8/1982 |
| DE | 20200584 | 5/2002 |
| EP | 0822289 | 2/1998 |
| EP | 0890676 | 1/1999 |

* cited by examiner

*Primary Examiner*—Jimmy T. Nguyen
(74) *Attorney, Agent, or Firm*—Greenblum & Bernstein, P.L.C.

(57) ABSTRACT

Calender and process for operating calender depending upon a desired surface quality, in which calender includes a plurality of nips located between end nips formed by replaceable rolls and end rolls. Process includes selectively guiding a web though several nips of calender and at least one end nip of calender, and when the web is selectively guided through the at least one end nip, selectively replacing the replaceable roll with one of a hard and a soft roll to form the at least one end nip with a hard roll and a soft roll or with two soft rolls. The replaceable roll being connectable to a temperature control device operated with a tempering capacity that depends on the type of the replaced roll. The instant abstract is neither intended to define the invention disclosed in this specification nor intended to limit the scope of the invention in any way.

23 Claims, 2 Drawing Sheets

METHOD FOR OPERATING A MULTI-ROLL CALENDAR AND A CALENDAR

CROSS-REFERENCE TO RELATED APPLICATIONS

The present application claims priority under 35 U.S.C. §119 of German Patent Application No. 10 2004 003 715.9-27, filed on Jan. 24, 2004, the disclosure of which is expressly incorporated by reference herein in its entirety.

BACKGROUND OF THE INVENTION

1. Field of the Invention

The invention relates to a method for operating a multi-roll calender in which a web is guided either through several nips of the calender or through only at least one end nip, depending on a desired surface quality. Furthermore, the invention relates to a calender with a roll stack of several rolls and nips formed between adjacent rolls, in which an end nip limited by an end roll and an intermediate roll is formed by a hard roll and a soft roll, and with a device for holding the intermediate roll limiting the end nip.

2. Discussion of Background Information

Such a method and such a calender are known, e.g., from German Application No. DE 202 00 584 U1. A calender of this type is used mainly to glaze a paper web. With this glazing the paper web is on the one hand condensed, but on the other hand also receives certain surface properties. The aim with the treatment of the paper web in a calender of this type is above all to be able to influence the smoothness of the paper web.

As a first approximation, it can be assumed that, the more nips that are involved in the glazing, the smoothness will be improved further. However, there are also grades of paper in which a high smoothness is not required or not even desired.

Depending on the grade of paper, therefore, either a multi-nip operation is used in which the web is guided through several nips, or a single-nip operating mode in which the web is treated only in a single nip. This nip is then arranged between an end roll and the adjacent intermediate roll. This intermediate roll can be fixed so that with the single-nip operating mode the remaining intermediate roll and the remaining end roll do not have to rotate along with it when "empty", thus without a web in the nip.

However, the treatment in a single nip in some cases also produces too great a smoothness. In the so-called "matt glazing" the aim is to be able to treat the web between two soft rolls. As a rule, a separate matt calender is necessary for this, which, as an auxiliary unit, incurs expense and requires space.

Supercalenders are also known in which a so-called changeover nip is formed of two soft nips approximately in the middle. If this changeover nip were used for matt glazing, all the rolls would have to be in operation, thus also the upper and lower roll and the other intermediate rolls, although they are not involved in the glazing process. This leads to an unnecessary wear of the surfaces of the rolls and to increased energy consumption. Such an operating mode is thus not desirable as a rule.

SUMMARY OF THE INVENTION

The present invention expands the treatment possibilities in a multi-roll calender.

Accordingly, the present invention provides a method of the type mentioned at the outset in that with exclusive use of at least one end nip, the end nip is either limited by a hard roll and a soft roll, or the hard roll is replaced by a soft roll and the end nip is limited by two soft rolls. Moreover, the replaced roll is connected to a temperature control device and the temperature control device is operated with a tempering capacity that depends on the type of the replaced roll.

The expense of the changeover between a matt glazing operating mode, in which the web is glazed between two soft rolls, and a different operating mode in which the web is glazed between a hard roll and a soft roll, is kept relatively low according to this embodiment. In the majority of cases, the hard roll is heated, because an increased temperature leads to an improved smoothness on the surface of the paper web. A temperature control device for the heated roll is therefore present. The temperature control device works in operation such that a heat transfer medium is fed to the hard roll at an increased temperature. The same temperature control device can now be used to remove heat that is generated during the operation of the soft roll. This heat is generated mainly by the working of the elastic cover of the soft roll. The same heat transfer fluid can be used for this. However, the task of this heat transfer fluid has changed. The aim is no longer to introduce heat into the roll, but to transport heat out of the roll. Through the common use of the temperature control device for both operating modes, the problem of the replaced soft roll becoming too heated is thus avoided. Although the temperature control device that is used to heat the hard roll often already has a cooling stage in order to be able to cool down the hot roll before dismantling, the amounts of heat to be removed here are relatively small. Cooling must not occur too quickly, so as to avoid thermal stresses in the hard roll during cooling. Also, the temperature control device for cooling has been hitherto used only for relatively short periods, but not for continuous operation. In contrast, according to the invention it is provided that the temperature control device can also be used for heat removal in the normal glazing operation.

It is hereby preferred for the operating mode of the temperature control device to be switched over with the replacement of the roll. To this end, for example, a switchover device can be available on the roll, which automatically switches over the temperature control device upon installation. Switchover devices of this type also include identifiers that are arranged on the roll and that can be automatically recognized by a recognition device, which then controls the operation of the temperature control device.

A scraper device is preferably installed on the replaced roll depending on the type of the replaced roll. The operating parameters of the scraper device, e.g., blade angle and blade load, are then adapted to the surface of the roll to be cleaned. As a rule, the contact pressure of the blade is reduced with a soft roll having an elastic cover. It can also be provided here for this adjustment to occur automatically with the replacement of the roll.

The temperature control device is preferably operated with oil. Oil is able to transport greater amounts of heat into the roll, in the case of a hard heated roll, and to transport heat out of the roll in the case of a soft roll.

The invention is directed to a calender of the type mentioned at the outset that includes a soft replacement roll having a connection arrangement for a temperature control device that corresponds geometrically to the connection arrangement of the hard roll limiting the end nip. The temperature control device is designed for heating a hard roll and removing heat from a soft roll.

With a calender of this type it is now possible, as set forth above, to matt glaze a web, in particular a paper web, by using two soft rolls, as well as to glaze in a "normal" manner, where a hard heated roll and a soft roll are used in the end nip. Since the hard heated roll and the replacement roll that can be used instead of this hard heated roll have the same geometric connection arrangement, it is easily possible to connect them to the same temperature control device without additional conversion measures being necessary. Since the temperature control device can be used both for supplying heat to the hard heated roll and for removing heat from the soft roll, no conversion is necessary here, either. The expense for the changeover between different glazing operating modes is thus kept relatively low.

The replacement roll and the replaceable hard roll preferably feature a switchover device that converts the temperature control device to the operating mode suitable for the operation of the respective roll. It is thus possible to convert the operating mode automatically. Therefore, there is no danger that the temperature control device will accidentally heat the soft roll or cool the hard roll. The risk of breakdowns that result from an inappropriate tempering of the respective rolls is thus kept relatively low.

The intermediate roll limiting the end nip is preferably embodied as a hard roll. Thus, a soft roll is used as an end roll, which in addition is embodied as a sag compensation roll. The replacement roll can then be embodied in a more cost-effective manner.

A scraper arrangement is preferably arranged at the position of the replacement roll, the operating parameters of which can be adjusted depending on the type of roll arranged in the position of the replacement roll. The scraper arrangement can be used to clean the surface of the respective roll in operation when using a hard roll as well as when using a soft roll. As the operating parameters, e.g., blade load and blade angle, can be adjusted depending on the type of installed roll, a conversion between the different operating modes is easily possible.

A web run through both end nips is preferably provided, and both hard intermediate rolls limiting the end nips can be replaced by a soft roll. A matt glazing operation in two nips is thus possible, namely in the two end nips. Both replaceable intermediate rolls can be connected to the temperature control device in order to supply heat when a hard roll is used and to remove heat when a soft roll is used.

The web run preferably runs through all the nips of the calender, whereby all nips are opened except for the end nips. Thus on the one hand the "normal" web run is retained, thus all guide devices and auxiliary units, such as dampening devices, can also be used as before. On the other hand, the rolls not involved in the glazing process are conserved. It is necessary only to replace the hard and heated intermediate rolls adjacent to the end rolls with soft rolls.

The present invention is directed to a process for operating a multi-roll calender depending upon a desired surface quality, in which the multi-roll calender includes a plurality of nips located between end nips formed by replaceable rolls and end rolls. The process including selectively guiding a web though several nips of the multi-roll calender and at least one end nip of the multi-roll calender, and when the web is selectively guided through the at least one end nip, selectively replacing the replaceable roll with one of a hard and a soft roll to form the at least one end nip with a hard roll and a soft roll or with two soft rolls. The replaceable roll being connectable to a temperature control device operated with a tempering capacity that depends on the type of the replaced roll.

In accordance with a feature of the invention, the process further includes switching over the operating mode of the temperature control device with the replacement of the replaceable roll.

According to another feature of the invention, the process can include positioning a scraper device on the replaceable roll depending on the type of the replaced roll.

According to still another feature of the present invention, the temperature control device is operated with oil.

The present invention is directed to a calender that includes a roll stack, composed of end rolls and at least one intermediate roll positioned between the end rolls, having an end nip formed between an end roll and the at least one intermediate roll. The at least one intermediate roll includes a replaceable roll, which is selectively a hard roll or soft roll. The calender includes a device for holding the at least one replaceable roll, and each replaceable roll has a connection arrangement for a temperature control device, in which the temperature control devices correspond to each other geometrically.

According to a feature of the present invention, the temperature control device can be structured and arranged for heating a hard roll and for removing heat from a soft roll.

In accordance with another feature of the invention, the replaceable rolls may include switchover devices structured and arranged to convert the temperature control device to an appropriate operating mode for the selected replaceable roll.

According to still another feature of the instant invention, the at least one replaceable roll includes a hard roll.

Further, the calender can also include a scraper arrangement structured and arranged at the replaceable roll, the operating parameters of which are adjustable depending on the selected replaceable roll.

Moreover, a web run is provided through both end nips, and each end nip may be formed by an end roll and a replaceable roll, and the replaceable roll can be selectively changed from a hard roll to a soft roll. The web run runs through all the nips of the calender, and all the calender nips, with the exception of the end nips, are opened.

The invention is directed to a calender including end rolls composed of soft rolls, and a plurality of intermediate rolls located between the end rolls. Intermediate rolls arranged adjacent the end rolls are replaceable rolls that are selectively hard or soft rolls, and the replaceable rolls include connection arrangements for temperature control device. A temperature control device is structured and arranged to heat the replaceable roll when selected as a hard roll and to remove heat from the replaceable roll when selected as a soft roll.

According to a feature of the present invention, the calender further includes devices for preventing positional movements of the replaceable rolls.

In accordance with another feature of the invention, the temperature control device can include a switchover device that changes the temperature control device from heating to heat removal. The replaceable rolls may include identifier elements readable by the temperature control device to identify the replaceable rolls as either hard rolls or soft rolls.

Moreover, all nips, with the exception of the end nips can be opened. The web can be guided to only the end nips. Further, the web may be guided through all of the nips.

The replaceable rolls are soft rolls, whereby the end nips are composed of two soft rolls. Alternatively, the replaceable rolls are hard rolls, whereby the end nips are composed of a soft roll and hard roll.

The present invention is directed to a process of calendering a web in a multi-roll calender, in which the multi-roll calender includes end rolls and a plurality of intermediate rolls located between the end rolls, in which the intermediate rolls adjacent the end rolls are hard rolls. The process includes opening the nips, replacing the hard roll with a soft roll, and calendering the web in only at least one end nip formed by the end roll and the adjacent soft roll.

In accordance with still yet another feature of the present invention, the process can also include determining the replacement of the hard roll, and changing a temperature control device coupled to the replaced soft roll from a heating mode to a heat removal mode.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
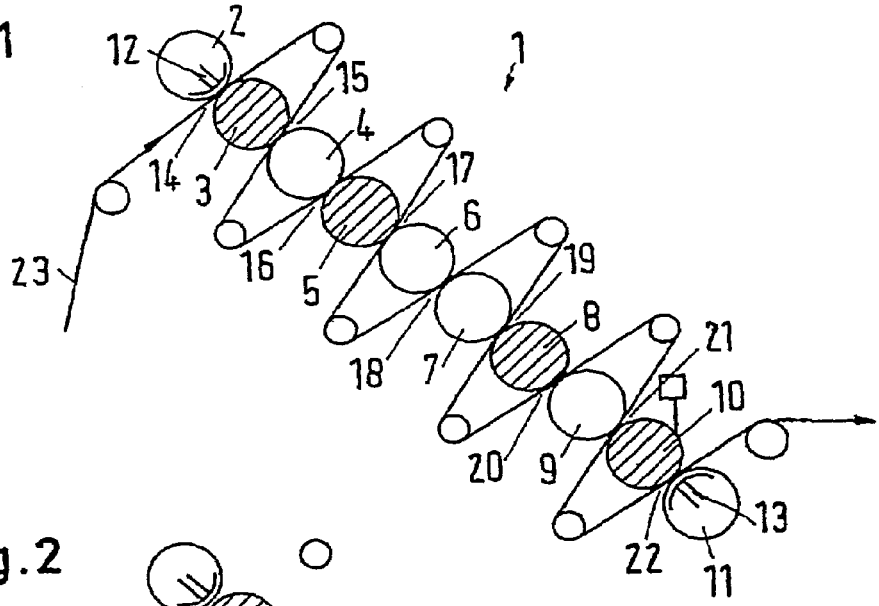
FIG. 1 illustrates a calender in a first operating mode.

FIG. 1 shows a calender 1 with ten rolls 2-11. Of the rolls 2-11, the rolls 2, 11 arranged at the end of the roll stack are embodied as sag (deflection) compensation rolls that are provided with support elements 12, 13 shown only in diagrammatic form. The rolls 2, 4, 6, 7, 9, and 11 are embodied as soft rolls, i.e., they feature an elastic cover on their surface (not shown in further detail). The rolls 3, 5, 8, and 10 are embodied as hard, heated rolls. This is indicated by a crosshatching. The hard, heated rolls are connected to a temperature control device (not shown in FIGS. 1 through 4) shown in FIG. 5. The temperature control device supplies heat to the hard heated rolls 3, 5, 8, and 10 so that their surface temperature is raised. Surface temperatures in the range of 60 to 120° C. are aimed for.

Nips 14-22 are embodied or formed between the rolls 2-11, through which nips a paper web 23 can be guided. The nips 14-17 and 19-22 are hereby embodied or formed as "soft" nips that are formed between a hard heated roll 3, 5, 8, 10 and a soft roll 2, 4, 6, 7, 9, 11 with an elastic surface covering. The paper web 23 is glazed in these nips 14-17, 19-22. A changeover nip 18 which is formed by two soft rolls 6, 7 is provided in order to allow both sides of the paper web to rest against hard rolls 3, 5 or 8, 10.

The calender 1 is thus embodied as a "classic" supercalender that is "normally" operated in the operating mode according to FIG. 1. In this normal operating mode, the paper web 23 is guided through all nips 14-22 and glazed everywhere (with the exception of the changeover nip 18).

Such an increase in smoothness of the paper web 23 can be undesirable. It is therefore also possible, as discernible with the operating mode according to FIG. 2, to guide the paper web 23 only through the last nip 22 that is formed between the lower end roll 11 and the hard intermediate roll 10 adjacent to this end roll. The last intermediate roll 10, i.e., the penultimate roll in the roll stack, is provided with a scraper arrangement 24 that features a scraper blade 25 resting on the surface of the roll 10 at a predetermined angle and with a predetermined contact pressure. The other rolls can also be provided with such scraper arrangements.

In order to make it possible for the pressurization of the paper web 23 to take place only in the nip 22, but not in the other nips 14-21, the last intermediate roll 10 can be fixed or held firmly. To this end, an adjustable stop 26 is provided which is embodied or formed, e.g., as a hydraulically activated piston-cylinder arrangement and which acts on an end 27 of a two-armed lever 28, at the other end 29 of which the last intermediate roll 10 is arranged.

Due to the stop 26, the last intermediate roll 10 can be held such that a pressurization of the web 23 is possible in the nip 22 through the lower end roll 11 without the other rolls 2-9 having to be used to support the last intermediate roll 10. Accordingly, the other nips 14-21 can remain opened as shown in FIG. 2.

Figure 2:
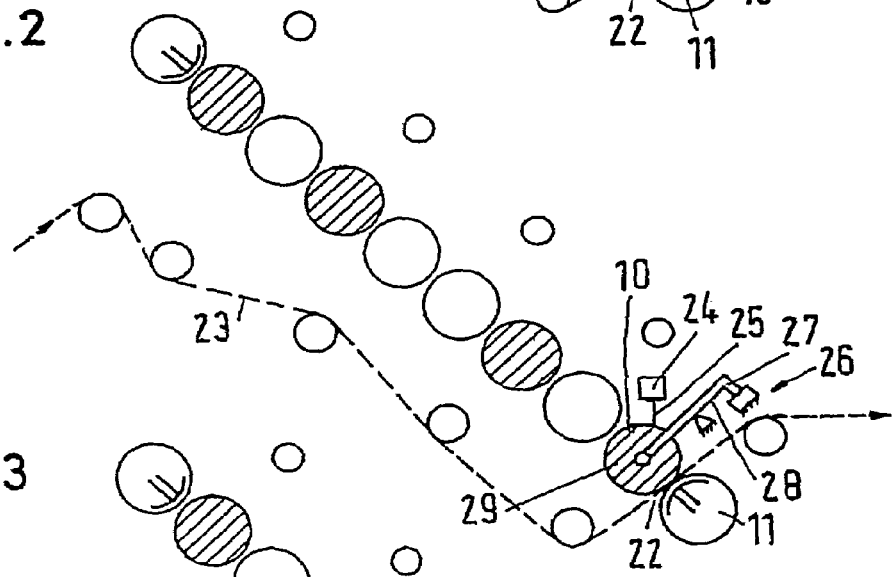
FIG. 2 illustrates the calender in a second operating mode.

FIG. 2 thus shows a so-called "single-nip" operation in which the paper web 23 is glazed only in a nip 22.

Figure 3:
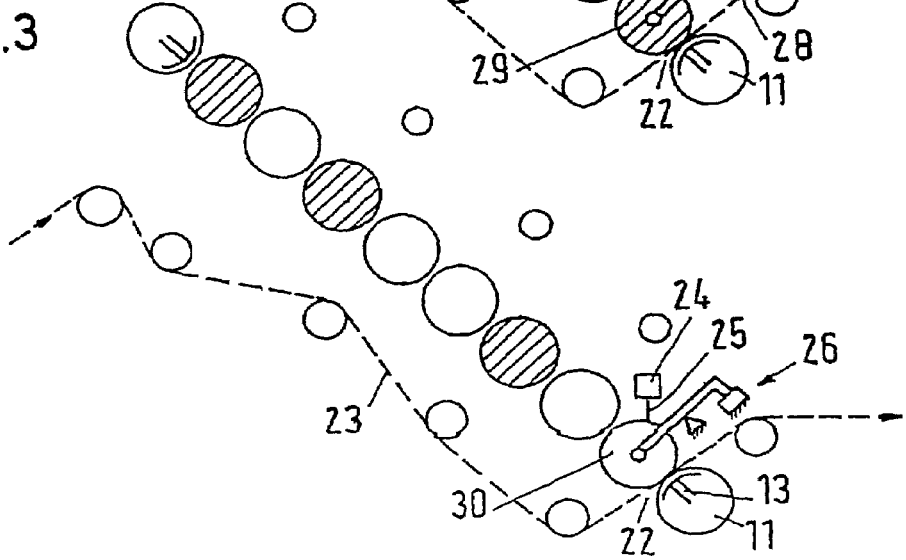
FIG. 3 illustrates the calender in a third operating mode.

Even a glazing of this type can cause too great an increase of smoothness. A replacement roll 30 is therefore provided for the calender 1, which, as can be seen in FIG. 3, has been installed at the position of the last intermediate roll 10. The replacement roll 30 is a soft roll. Accordingly, the paper web 23 is glazed in the last nip 22 between two soft rolls 11, 30.

The soft roll 30 is likewise cleaned by the scraper arrangement 24, however, it is provided that the operating parameters of the scraper arrangement 24 may be changed and/or adapted to the surface of the soft roll 30. In particular the contact pressure of the scraper blade 25 is reduced and, if necessary, the pitch angle is also changed.

The soft roll 30 is also held by the stop 26 so that a pressurization of the paper web 23 is possible in the last nip 22 via the roll 11 without the other rolls having to rotate as well.

Figure 4:
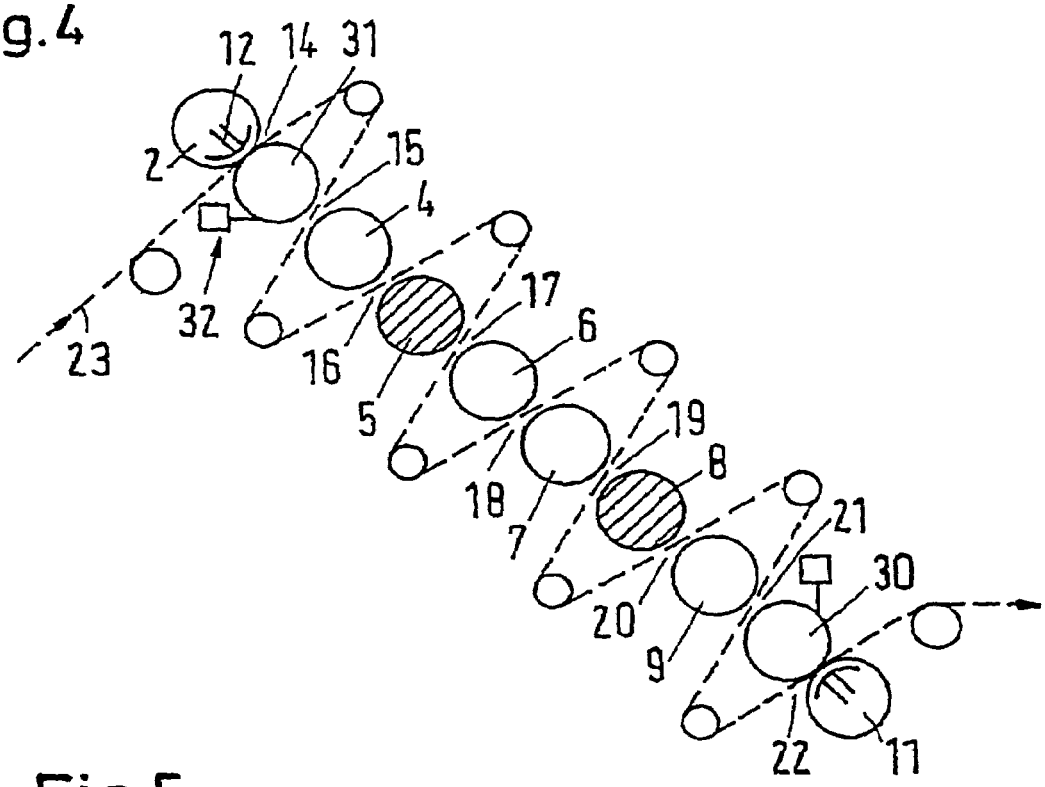
FIG. 4 illustrates the calender in a fourth operating mode.

FIG. 4 now shows a fourth operating mode in which the paper web 23 is guided through the calender in exactly the same way as shown in FIG. 1. However, here only the first nip 14 and the last nip 22 are closed. The other nips 15-21 are opened. The rolls 4-9 involved with these nips can rotate too, but are not loaded by pressure.

The soft roll 30 is also installed at the position of the last intermediate roll 10 (FIG. 1) with the operating mode according to FIG. 4. A soft roll 31 is also used at the position of the upper heated hard intermediate roll 3. Together with the upper soft end roll 2, the soft roll 31 likewise forms a soft-soft nip.

The upper soft intermediate roll 31 is also provided with a scraper arrangement 32 that cleans the surface of the soft intermediate roll 31 in operation.

Figure 5:
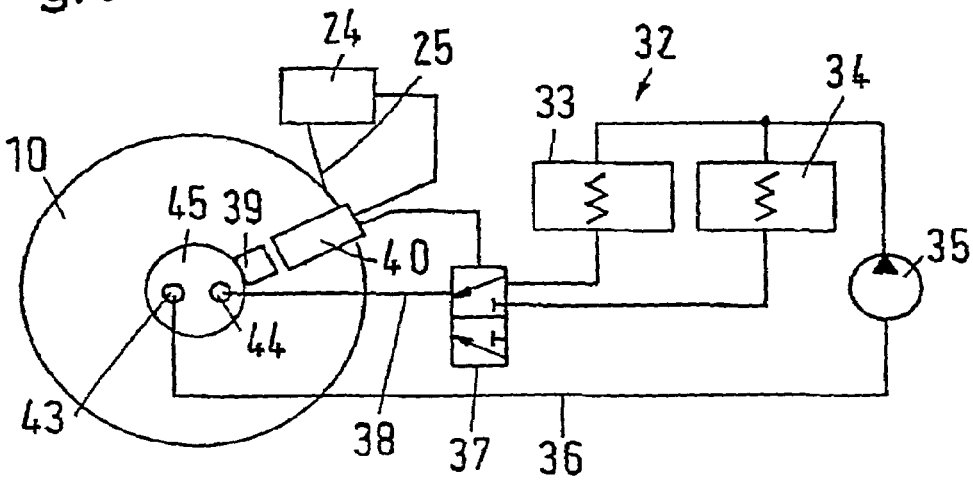
FIG. 5 illustrates a representation of replaceable rolls.
Figure 5:
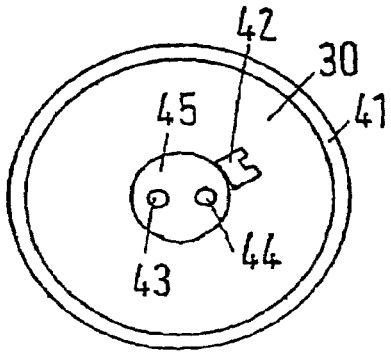

The replacement of a hard roll 3, 10 by a soft roll 31, 30 is easily possible because the two rolls have the same connection geometry, as shown in diagrammatic form in FIG. 5.

In FIG. 5, the hard roll 10 is connected to a temperature control device 32 via connections 43, 44 that are embodied in the plug 45. Temperature control device 32 features a heating device 33 and a cooling device 34. A pump 35 is provided to feed a heat transfer fluid, which in the exemplary embodiment is oil, from a return line 36 connected to the connection 43, to the heating device 33 and the cooling device 34. The heating device 33 and the cooling device 34 are embodied or formed, as is known, as heat exchangers.

A valve 37 is provided to connect a feed connection 38 of the roll 10, which is connected to the connection 44, either to the heating device 33 or to the cooling device 34. The connection is made depending on the type of roll that is installed at the position of the lower intermediate roll 10. If it is a hard roll 10, as shown in FIG. 5, the roll 10 is connected to the heating device 33, so that a predetermined amount of heat that leads to an increase in temperature of the surface is fed to the roll 10.

The roll 10 is provided with a probe 39 that can be scanned by a sensor of a control device 40. The control device 40 controls the valve 37 on the one hand and the scraper arrangement 24 on the other hand, i.e., the control device 40 adjusts the contact pressure and the pitch angle of the scraper blade 25 depending on the type of roll.

FIG. 5 likewise shows that the soft roll 30 with the elastic cover 41 on the surface is kept ready to replace the roll 10. The soft roll 30 has the same connection geometry with the connections 43, 44 and the plug 45 as the hard 10, but a different probe 42 that likewise can be recognized by the sensor of the control device 40. When the control device 40 recognizes that a soft roll is used, the valve 37 is switched over in order to connect the roll 30 to the cooling device 34. With the aid of the cooling device, heat transfer fluid is pumped through the roll 30 in order to transport away heat that occurs during operation. The heat occurs, e.g., through the working of the elastic cover 41.

As can be seen in FIG. 5, the hard roll 10 and the soft roll 30 feature the same connection geometry for the temperature control device 32. Thus only the soft roll 30 needs to be installed instead of the hard roll 10 (or vice versa) in order to be able to implement another operating mode of the calender 1.

The representation of FIG. 5 is shown in greatly diagrammatic form. Of course, it is also possible to cool the hard roll 10 with the cooling device 34 if this should be necessary, e.g., before dismantling.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. A process for operating a multi-roll calender depending upon a desired surface quality, in which the multi-roll calender includes a plurality of nips located between end nips formed by replaceable rolls and end rolls, said process comprises:

selectively guiding a web though several of the plurality of nips of the multi-roll calender and at least one of the end nips of the multi-roll calender; and when the web is selectively guided through the at least one end nip, selectively replacing the replaceable roll with a replacing roll composed of one of a hard and a soft roll to form the at least one end nip with a hard roll and a soft roll or with two soft rolls, wherein the replacing roll is connectable to a temperature control device operated with a tempering capacity that depends on whether the replacing roll is a hard roll or a soft roll.

2. The process in accordance with claim 1, further comprising switching over an operating mode of the temperature control device with the replacement of the replaceable roll.

3. The process in accordance with claim 1, further comprising positioning a scraper device on the replacing roll, wherein operating parameters for the scraper device vary depending on whether the replacing roll is a hard roll or a soft roll.

4. The process in accordance with claim 1, wherein the temperature control device is operated with oil.

5. A calender comprising:

a roll stack, composed of end rolls and at least one intermediate roll positioned between said end rolls, having an end nip formed between one of said end rolls and said at least one intermediate roll;

said at least one intermediate roll comprising a replaceable roll, which is selectively a hard roll or soft roll;

a device for holding said replaceable roll;

a temperature control device selectively coupleable to the hard roll or soft roll; and said at least one intermediate roll comprising a replaceable roll having a connection arrangement connectable to the temperature control device, wherein the connection arrangement for the hard roll is geometrically difference than the connection arrangement for the soft roll.

6. The calender in accordance with claim 5, wherein said temperature control device is structured and arranged for heating a hard roll and for removing heat from a soft roll.

7. The calender in accordance with claim 5, wherein said at least one intermediate roll comprising a replaceable roll is a plurality of intermediate rolls composed of replaceable rolls, and wherein said replaceable rolls include switchover devices structured and arranged to convert the temperature control device to an appropriate operating mode for the selectively hard or soft replaceable roll.

8. The calender in accordance with claim 5, wherein said at least one intermediate roll comprising a replaceable roll comprises a hard roll.

9. The calender in accordance with claim 5, further comprising a scraper arrangement, structured and arranged at said replaceable roll, having adjustable operating parameters depending on whether the replaceable roll is the selectively hard roll or soft roll.

10. The calender in accordance with claim 5, wherein a web run is provided through both said end nips, and each end nip is formed by an end roll and a replaceable roll.

11. The calender in accordance with claim 10, wherein the replaceable roll is selectively changed from a hard roll to a soft roll.

12. The calender in accordance with claim 11, wherein the web run runs through all the nips of the calender, and all the calender nips, with the exception of the end nips, are opened.

13. A calender comprising:

end rolls composed of soft rolls;

a plurality of intermediate rolls located between the end rolls;

ones of said plurality of intermediate rolls arranged adjacent said end rolls being replaceable rolls that are selectively hard or soft rolls;

said replaceable rolls comprising connection arrangements for a temperature control device; and said temperature control device being structured and arranged, based upon said connection arrangements, to heat said selectively replaceable hard roll and to remove heat from said selectively replaceable soft roll.

14. The calender in accordance with claim 13, further comprising devices for preventing positional movements of said replaceable rolls.

15. The calender in accordance with claim 13, said temperature control device comprising a switchover device that changes the temperature control device from heating to heat removal.

16. The calender in accordance with claim 15, wherein said replaceable rolls comprise identifier elements readable by said temperature control device to identify the replaceable rolls as either hard rolls or soft rolls.

17. The calender in accordance with claim 13, wherein all nips, with the exception of end nips formed between said end rolls and said replaceable rolls are opened.

18. The calender in accordance with claim 17, wherein the web is guided to only the end nips formed between said end rolls and said replaceable rolls.

19. The calender in accordance with claim 17, wherein the web is guided through all of the nips.

20. The calender in accordance with claim 13, wherein said replaceable rolls are soft rolls, whereby end nips formed between said end rolls and said replaceable rolls are composed of two soft rolls.

21. The calender in accordance with claim 13, wherein said replaceable rolls are hard rolls, whereby end nips formed between said end rolls and said replaceable rolls are composed of a soft roll and hard roll.

22. A process of calendering a web in a multi-roll calender, in which the multi-roll calender includes end rolls and at least one intermediate roll located between the end rolls, in which the at least one intermediate roll is adjacent at least one of the end rolls, and the at least one intermediate roll is a hard roll, said process comprising:

opening nips formed between the rolls of the multi-roll calender;

replacing the hard roll with a soft roll; and calendering the web in at least one end nip formed by the at least one of the end rolls and the soft roll.

23. The process in accordance with claim 22, further comprising:

determining the replacement of the hard roll; and changing a temperature control device coupled to the replaced soft roll from a heating mode to a heat removal mode.

* * * * *